US006566989B1

(12) United States Patent
Linnarud et al.

(10) Patent No.: US 6,566,989 B1
(45) Date of Patent: May 20, 2003

(54) CONTACTOR

(75) Inventors: Krister Linnarud, Västerås (SE); Joakim Wåhrenberg, Västerås (SE); Arne Axelsson, Västerås (SE); Mats Johansson, Västerås (SE); Tomas Baltzer, Enkoping (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/890,123

(22) PCT Filed: Jan. 13, 2000

(86) PCT No.: PCT/SE00/00054

§ 371 (c)(1),
(2), (4) Date: Oct. 18, 2001

(87) PCT Pub. No.: WO00/45406

PCT Pub. Date: Aug. 3, 2000

(30) Foreign Application Priority Data

Jan. 28, 1999 (SE) ..... 9900280

(51) Int. Cl.[7] ..... H01H 67/02
(52) U.S. Cl. ..... 335/132; 335/202
(58) Field of Search ..... 335/16, 8–10, 335/202, 132; 200/293–308

(56) References Cited

U.S. PATENT DOCUMENTS 3,651,437 A 3/1972 Kiyoshi
4,800,352 A * 1/1989 Haury et al. ..... 335/132
4,973,929 A * 11/1990 Duchemin ..... 335/132
5,012,215 A * 4/1991 Floc'h ..... 335/132
5,381,119 A * 1/1995 Robbins et al. ..... 335/132
5,825,269 A * 10/1998 Koppmann ..... 335/132
5,828,277 A * 10/1998 Duchemin ..... 335/132

FOREIGN PATENT DOCUMENTS

DE 1625369 7/1970
EP 0046921 3/1982

* cited by examiner

*Primary Examiner*—Lincoln Donovan
(74) *Attorney, Agent, or Firm*—Dykema Gossett PLLC

(57) ABSTRACT

A contactor having electromagnetically operated contacts, wherein main contacts and connections for power supply are arranged in a bottom area of the contactor and contact control means such as electric magnet and coil are arranged above the main contacts. The contactor includes a contactor enclosure being sequentially detachable in two dependent, successive steps through a locking element utilized by both.steps, such that in a first step access is provided to the contactor main contacts, and in a second step access is provided to the electric magnet and coil. The locking element is formed to engage a first and second arresting seat defined in the contactor enclosure. The arresting seats are arranged to urge the locking element into engagement with the second arresting seat as the locking element is released from engagement with the first arresting seat.

7 Claims, 3 Drawing Sheets

CONTACTOR

RELATED APPLICATIONS

The present application claims the benefit of priority to SE-9900280, filed Jan. 28, 1999.

TECHNICAL FIELD

The present invention relates to a relay or contactor, wherein measures are taken to facilitate assembly and disassembly in installation and maintenance. By way of construction, the inventive contactor also contributes to better security in operation and service. More specifically, the invention suggests a contactor that is structured to permit assembly and disassembly only in a specified sequential operation.

Typical contactors of this kind have an electric magnet for non-manual operation of contacts to close and break, respectively, an electric current circuit, e.g. a triple-pole alternating current. Control current is supplied to a coil of the electric magnet, and a magnet movement is employed for closing or breaking the electric circuit. In addition to main contacts, the contactor also has secondary contacts and current connections for the control current, that may be controlled manually or electronically.

Contactors of this kind are employed in industrial applications as motor switches, e.g., and are commonly installed at supply central units to which system current and control current is supplied to feed multiple current consumers. Thus, the central units may receive a large number of electric conductors, so that major caution is required in service operations for maintenance, repairs or for replacing worn out components. Such service may expose technicians and other personnel to a latent risk of injury. Usually, switches for the control power are situated away from the central unit, so that service personnel may not at all times be in complete control of the status of the electric magnet. This situation involves the risk of the system power being unintentionally supplied during service, e.g. when replacing the main contacts of the contactor.

In service operations on such installations, it is therefore a desire and a problem to facilitate the work on the contactor, and concurrently to minimize the risk of engagement with electrified circuits.

It is further desirous to reduce the length of service interrupts for maintenance work, by facilitating access to worn out components in replacement works. It is also desirous to minimize the number of separate details needed for assembly and disassembly of the equipment in connection with service operations.

OBJECT OF INVENTION

The object of this invention is to meet the above-identified desires, and to solve the problems arising therefrom.

SUMMARY OF THE INVENTION

According to the invention, these objects are met in a contactor comprising a contactor enclosure that is sequentially detachable in two successive steps, each step depending from the other. In a first step, the components of the control power circuit as well as the contacts for the system power circuit are unitarily detached in order to permit access to the system power contacts. In said first step, the contacts of the control power circuit are still enclosed by a detachable part of the contactor enclosure. Then, in a second step, access is made to the components of the control power circuit by opening the detachable part of the enclosure. A main feature of the invention is that the two steps for opening the enclosure are both controlled by a number of common locking elements, formed to engage alternative arresting seats for partial or complete access to internal components and operative details of the contactor, thereby avoiding an unintentional supply of system power when the contactor enclosure is detached in said first step.

The characterizing features of the invention are defined by independent claim 1, and preferred embodiments are defined in the sub-claims.

DRAWINGS

The inventive contactor is further disclosed below, reference being made to the accompanying drawings illustrating an embodiment of the invention. In the drawings, FIG. 1 is sectional view through a contactor along a plane that is parallel to the system power path, the enclosure in fully attached position;

DETAILED DESCRIPTION

Figure 1:
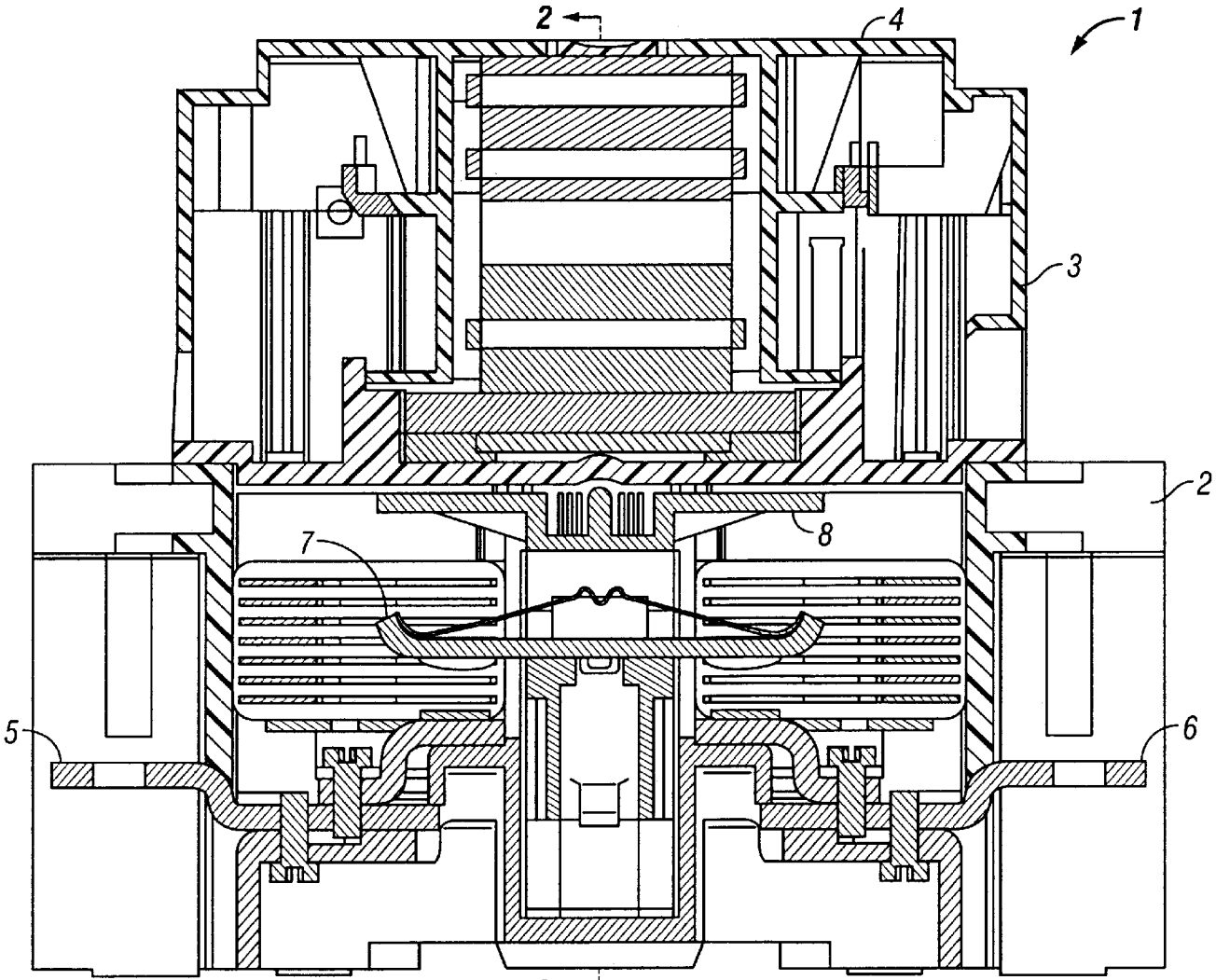
Figure 2:
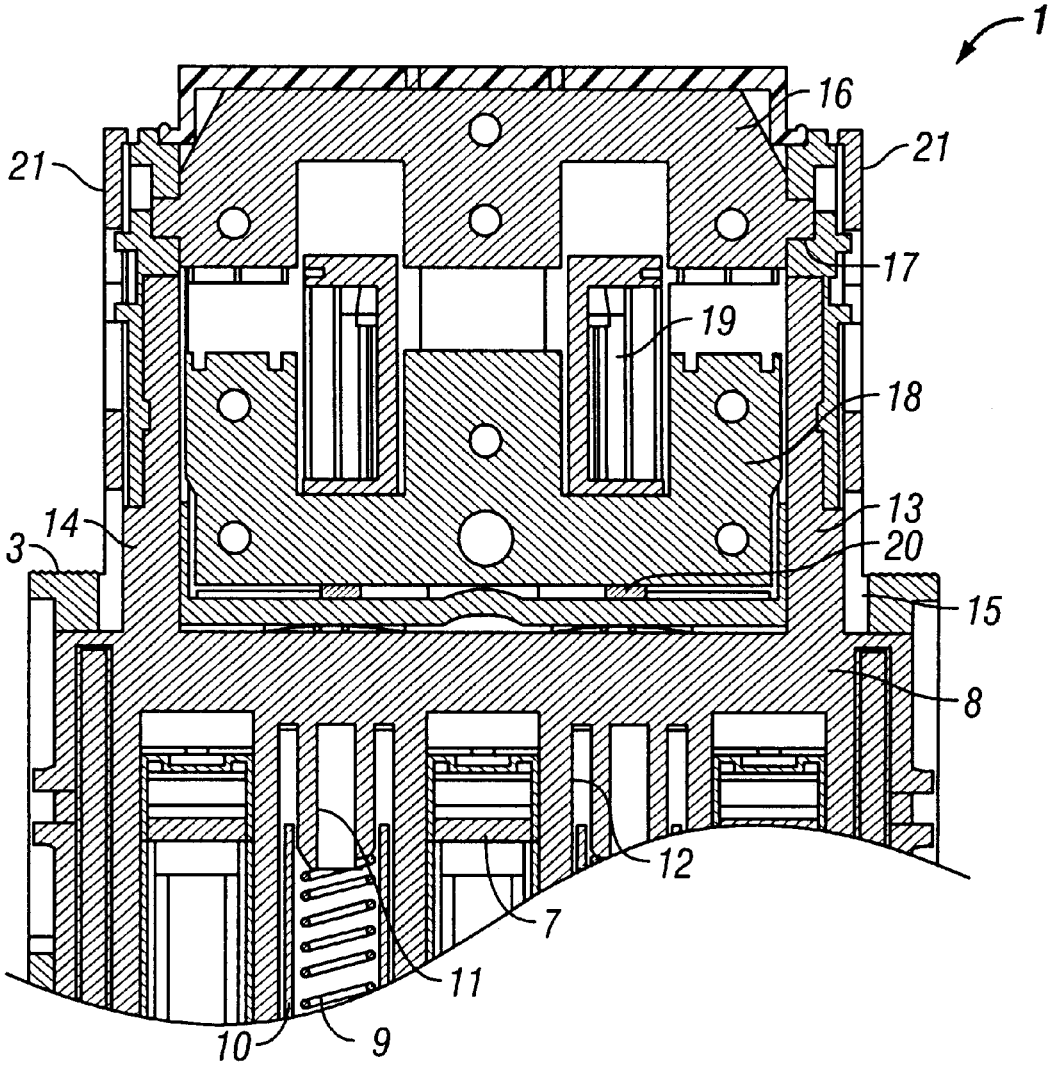
FIG. 2 is sectional view along the plane 11—11 of FIG. 1.
Figure 3:
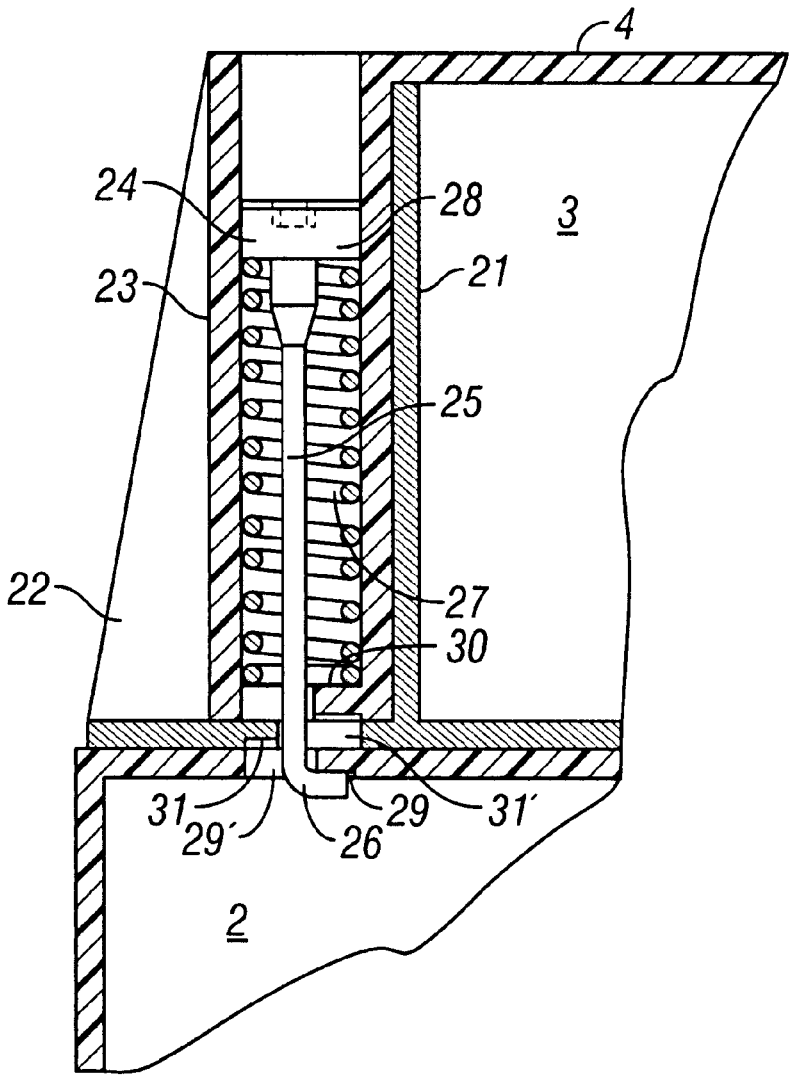
FIG. 3 is a partial section, illustrating diagrammatically the locking pin in cooperative engagement with the contactor enclosure.

Reference being made to the drawings, FIGS. 1–3 illustrate an example for a contactor 1 that is designed for implementation of the inventive teachings.

The contactor 1 is an electromagnetic relay operative to control a triple-pole system power current. The operative elements of the contactor 1 are designed to provide better maintenance security and effectiveness, in accordance with this invention. Basically, contactor 1 comprises connections for system power, contacts, electric magnet, coil and connections for the control power as known per se, and may further include elements for adapting the contactor to a specified application.

According to the invention there is provided a contactor enclosure comprising three main components: a housing 2 permanently incorporated in the system current path, a removable casing 3 accommodated by the housing 2, and a cover 4 that seals the casing.

The contactor housing 2 is permanently positioned in the current path through fastening means, not further shown, so that a bottom side of the housing 2 is seated on a support structure. Input and output connection means 5,6 are accommodated in the bottom area of the housing 2, as best seen in FIG. 1, for connecting the system power phase conductors to the contactor 1. In the shown embodiment, the connection means 5,6 are two-part elements that are fixedly mounted by screws in the housing 2, and may preferably be located in disconnection cells formed in the housing 2 and equipped with arc shielding means.

Each pair of connection means 5,6 cooperates with a separate contact 7. The contact 7 is supported to be movable from a circuit breaking position shown in FIGS. 1 and 2, to a circuit closing position wherein the contact 7 is moved to engagement with the connection means 5,6. The contacts 7 are supported in a circuit breaking bridge 8, that is movable in the housing 2 against the force of springs 9. The springs 9 are seated in spring guides 10 extending out from the bottom of the housing 2. The breaking bridge 8 is bridge-shaped to reach transversely over the contactor. Shoulders 11, acting as seats for the springs 9, are formed in the bottom surface of the breaking bride 8. Each contact 7 is supported in a socket 12, extending out from the bottom surface of the breaking bridge, and seated to be biased by a spring (not further shown). Preferably, the socket 12 is integrally formed in the housing 2 to provide separate paths for the system power through the contactor 1.

The breaking bridge 8 is formed with a pair of columns 13,14 extending out from the upper surface of the bridge and passing through slots 15, formed in opposite sides of the casing 3 which is removably attached to the housing 2. Between upper ends of the columns 13,14 there is supported an electromagnet armature 16, resting on seats 17 formed on the columns or in separate carriers, engaging the columns to transfer the armature movement to the breaking bridge and the contacts 7 in a circuit closing motion.

An electromagnet armature having a magnetized core 18 and a coil 19 is arranged in the bottom area of casing 3. Flexible or elastomer inserts 20 may be arranged between the core and the bottom of the casing in order to permit some relative motion there between. Moreover, and not further disclosed, the housing 2, casing 3 and breaking bridge 8 are suitably formed to guide and facilitate the breaking bridge motion between the circuit closing and breaking positions.

The breaking bridge 8 with the contacts 7, and the casing 3 with the electromagnet armature, core and coil of the control power circuit, form together an assembly which as a whole is detachable from the contactor 1.

The casing 3 has a surrounding wall 21, wherein recesses 22 are formed in each corner of the casing (see FIG. 3). Each recess 22 receives a leg 23 depending from the corners of the cover 4. In attached the position, wherein the cover 4 sealingly rests on the upper edge of the surrounding wall 21, the legs 23 bear against the bottom of the casing, in the bottom areas that reach into the recesses. The inventive teachings are not limited to a certain number of legs 23, preferably though, at least two such legs are provided.

The cover 4 and casing 3 has a common locking element or locking pin 24 that runs through the leg 23. The locking pin 24 comprises a shaft 25, formed in the lower end with a hook 26 that is angled to extend substantially perpendicular from the shaft. A helical spring 27 is supported on the shaft, between hook 26 and a slotted head 28 formed in the opposite end of the shaft.

In the attached position of the contactor enclosure, the locking pin 24 reaches through the cover 4 to engage an arresting seat 29, formed in the housing 2 and cooperating with the hook 26 of the locking pin. The locking pin is spring biased in the arrested position as the helical spring is compressed between the head 28 and a bottom area 30, formed in the lower end of the leg 23. This way, the cover 4, the casing 3 and the housing 2 are locked together by the common locking pin to provide the sealed contactor enclosure 1.

When a twist is applied to the locking pin, the hook 29 is released from the arresting seat 29 of the housing 2. Upon this twist, the locking pin is brought to engage a second arresting seat 31, formed on the lower surface of the bottom of casing 3.

Now, the casing 3 and the cover 4 may be detached from the housing 2 in order to expose the connection means 5,6 that are accommodated in the bottom area of the housing 2. By this first step of detachment, the breaking bridge 8 with contacts 7 as well as the control circuit elements such as electric magnet, coil and supply conductors for control power, will be detached as a unit. The control circuit elements are still enclosed by the walls and bottom of the casing 3 and the cover 4, as the locking pin is in engagement with the second arresting seat formed in the bottom of the casing.

By further twisting the locking pin 24, the hook 26 is released from the arresting seat 31 of the casing 3, and the cover 4 is detachable to permit access to the operative elements of the control circuit in a second step of detachment.

The arresting seats 29 and 31 are formed with elongate apertures 29' and 31', respectively, extending angularly separated in radial directions from the turning center of the locking pin so as to provide a passage for the locking pin through either aperture when rotated to the appropriate position, and when further rotated, to permit passage through the other aperture. In all other turning positions, the locking pin is spring biased to engage the material of the house and casing, respectively. Preferably, the arresting seats will be defined in the material, e.g. through recesses, such that a definite indication of the locking pin's arrested position is provided, and thus an unintentional twisting of the locking pin 24 is prevented. As will be seen from FIG. 3 of the drawings, the locking pin is automatically positioned for engagement with the arresting seat 31, when being rotated out of engagement with the arresting seat 29. Preferably, the apertures are oriented in opposite radial directions from the locking pin turning center, even though alternative angular displacement lies within the teachings of the invention.

Attachment or assembly of the contactor enclosure is achieved by performing the two steps in reversed order. Accordingly, in a first step the cover 4 is attached to the casing 3 by turning the locking pin to engage the second arresting seat 31 of the cover, and successively in a second step the casing, carrying the breaking bridge 8, is attached to the housing 2 by turning the locking pin to engage the first arresting seat 29 of the housing 2.

Thus, in two sequential and dependant steps, service personnel is alternatively provided access for maintenance of one or both power circuits of the contactor by using a minimum number of locking elements. This is made possible by integrally forming the contactor enclosure with two mutually dependant locking actions. The possibility of unintentionally closing the power circuit when the contactor enclosure is removed for maintenance is thereby eliminated through the specific structure and sequential disassembly of the contactor enclosure. Therefore, the object of invention is met in a contactor that is formed in accordance with the disclosed example of an embodiment, and the attached claims are drafted to include also such modification, that would be perceivable to the man skilled in this technical field when being presented the teachings of the above disclosure.

What is claimed is:

1. An enclosure for a contactor employing connection means and contact control means, said enclosure comprising:

a housing for receiving the connection means therein;

a casing for receiving the contact control means therein, said casing being detachably secured to said housing and closing said housing when secured thereto;

a cover being detachably secured to said casing for closing said casing when secured thereto; and a locking element for detachably securing said housing, casing and cover together, said housing and casing having respective first and second arresting seats for sequentially engaging said locking element, wherein said housing being detachable from said casing and said cover being detachable from said casing by operation of said locking element, said locking element being arranged to engage said first arresting seat to detachably secure said housing and casing together, and said arresting seats being arranged to urge said locking element out of engagement with said first arresting seat and into engagement with said second arresting seat to secure said cover to said casing as said locking element is released from engagement with said first arresting seat to separate said housing from said casing.

2. The enclosure of claim 1, wherein said connection means are joined with said contact control means to form a unit that is supported on said housing and detachable therefrom, said locking element engages said housing and is detachable therefrom, said locking element engages said housing in said first arresting seat, and engages said detachable unit in said second arresting seat.

3. The enclosure of claim 1, said locking element including a locking pin biased by a spring load and being urged into engagement with said second arresting seat when released from engagement with said first arresting seat.

4. The enclosure of claim 3, wherein said locking pin being received in said cover and rotatable in said first step to be released from engagement with said first arresting seat against bias of said spring, and rotatable in said second step to be released from engagement with said second arresting seat to where said locking pin is urged through rotation in said first step.

5. The enclosure of claim 3, wherein said locking pin comprises a shaft, one end of which is formed with an angular hook which is turned to pass an aperture formed in said housing when the locking pin is released from engagement with said first arresting seat, and turned to pass an aperture formed in said detachable unit when said locking pin is released from engagement with said second arresting seat, said apertures being extended in angular displacement in separate radial directions from a turning center of said locking pin.

6. The enclosure of claim 5, wherein said apertures are extended in opposite radial directions from said locking pin turning center.

7. The enclosure of claim 2, wherein contacts of said contactor are supported in a breaking bridge, movable relative to said contactor housing, said breaking bridge being movably received in a casing also accommodating said contact control means, such that said contacts and said contact control means form a unit which as a whole is detachable from said contactor housing.

* * * * *